US009308618B2

(12) United States Patent
Benvegnu

(10) Patent No.: US 9,308,618 B2
(45) Date of Patent: Apr. 12, 2016

(54) LINEAR PREDICTION FOR FILTERING OF DATA DURING IN-SITU MONITORING OF POLISHING

(75) Inventor: Dominic J. Benvegnu, La Honda, CA (US)

(73) Assignee: Applied Materials, Inc., Santa Clara, CA (US)

( * ) Notice: Subject to any disclaimer, the term of this patent is extended or adjusted under 35 U.S.C. 154(b) by 899 days.

(21) Appl. No.: 13/456,801

(22) Filed: Apr. 26, 2012

(65) Prior Publication Data

US 2013/0288572 A1 Oct. 31, 2013

(51) Int. Cl.
*B24B 37/00* (2012.01)
*B24B 37/013* (2012.01)
*B24B 49/10* (2006.01)

(52) U.S. Cl.
CPC ..... *B24B 37/013* (2013.01); *B24B 49/10* (2013.01)

(58) Field of Classification Search
CPC ..... B24B 49/10; B24B 49/12; B24B 37/013; H01L 21/302; H01L 22/12; H01L 22/10; H01L 22/20
See application file for complete search history.

(56) References Cited

U.S. PATENT DOCUMENTS 5,036,015 A * 7/1991 Sandhu et al. ..... 438/14
5,069,002 A * 12/1991 Sandhu et al. ..... 451/1
5,846,882 A 12/1998 Birang
5,865,665 A * 2/1999 Yueh ..... 451/5
6,165,051 A * 12/2000 Weisshaus et al. ..... 451/8
6,290,572 B1 * 9/2001 Hofmann ..... 451/5
6,293,845 B1 * 9/2001 Clark-Phelps ..... 451/5
6,464,824 B1 * 10/2002 Hofmann et al. ..... 156/345.16
6,747,283 B1 * 6/2004 Amartur ..... 250/559.27
2003/0181131 A1 * 9/2003 Lehman et al. ..... 451/5
2004/0117054 A1 6/2004 Gotkis et al.
2004/0198180 A1 * 10/2004 Toprac ..... 451/5
2006/0015206 A1 * 1/2006 Funk et al. ..... 700/121
2006/0246820 A1 * 11/2006 Hofmann ..... 451/5
2011/0318992 A1 * 12/2011 David et al. ..... 451/5

FOREIGN PATENT DOCUMENTS

KR 10-2008-0102936 11/2008

OTHER PUBLICATIONS

International Search Report and Written Opinion in International Application No. PCT/US2013/035514, mailed Jul. 12, 2013, 10 pages.
Welch, Greg and Bishop, Gary, "An Introduction to the Kalman Filter," Jul. 24, 2006 [online] Retrieved from http://www.cs.unc.edu/~welch/media/pdf/kalman_intro.pdf, 16 pages.

* cited by examiner

*Primary Examiner* — Lee D Wilson
*Assistant Examiner* — Tyrone V Hall, Jr.
(74) *Attorney, Agent, or Firm* — Fish & Richardson P.C.

(57) ABSTRACT

A method of controlling polishing includes polishing a substrate, during polishing monitoring the substrate with an in-situ monitoring system, the monitoring including generating a signal from a sensor, and filtering the signal to generate a filtered signal. The signal includes a sequence of measured values, and the filtered signal including a sequence of adjusted values. The filtering includes for each adjusted value in the sequence of adjusted values, generating at least one predicted value from the sequence of measured values using linear prediction, and calculating the adjusted value from the sequence of measured values and the predicted value. At least one of a polishing endpoint or an adjustment for a polishing rate is determined from the filtered signal.

20 Claims, 2 Drawing Sheets

LINEAR PREDICTION FOR FILTERING OF DATA DURING IN-SITU MONITORING OF POLISHING

TECHNICAL FIELD

This disclosure relates to using applying a filter to data acquired by an in-situ monitoring system to control polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, the polishing endpoint usually cannot be determined merely as a function of polishing time.

In some systems, the substrate is monitored in-situ during polishing, e.g., by monitoring the torque required by a motor to rotate the platen or carrier head. However, existing monitoring techniques may not satisfy increasing demands of semiconductor device manufacturers.

SUMMARY

A sensor of an in-situ monitoring system typically generates a time-varying signal. The signal can be analyzed to detect the polishing endpoint. A smoothing filter is often used to remove noise from the "raw" signal, and the filtered signal is analyzed. Since the signal is being analyzed in real time, causal filters have been used. However, some causal filters impart a delay, i.e., the filtered signal lags behind the "raw" signal from the sensor. For some polishing processes and some endpoint detection techniques, e.g., monitoring of motor torque, the filter can introduce an unacceptable delay. For example, by the time that the endpoint criterion has been detected in the filtered signal the wafer is already significantly over-polished. However, a technique to counteract this problem is to use a filter that includes linear prediction based on the data from the signal.

In one aspect, a method of controlling polishing includes polishing a substrate, during polishing monitoring the substrate with an in-situ monitoring system, the monitoring including generating a signal from a sensor, and filtering the signal to generate a filtered signal. The signal includes a sequence of measured values, and the filtered signal including a sequence of adjusted values. The filtering includes for each adjusted value in the sequence of adjusted values, generating at least one predicted value from the sequence of measured values using linear prediction, and calculating the adjusted value from the sequence of measured values and the predicted value. At least one of a polishing endpoint or an adjustment for a polishing rate is determined from the filtered signal.

Implementations can include one or more of the following features. The in-situ monitoring system may be a motor current monitoring system or motor torque monitoring system, e.g., a carrier head motor current monitoring system, a carrier head motor torque monitoring system, a platen motor current monitoring system or a platen motor torque monitoring system. Generating at least one predicted value may include generating a plurality of predicted values. Calculating the adjusted value may include applying a frequency domain filter. The plurality of predicted values may include at least twenty values. Calculating the adjusted value may include applying a modified Kalman filter in which linear prediction is used to calculate the at least one predicted signal value.

In another aspect, a non-transitory computer-readable medium has stored thereon instructions, which, when executed by a processor, causes the processor to perform operations of the above method.

Implementations can include one or more of the following potential advantages. Filter delay can be reduced. Polishing can be halted more reliably at a target thickness.

The details of one or more embodiments are set forth in the accompanying drawings and the description below. Other aspects, features and advantages will be apparent from the description and drawings, and from the claims.

DESCRIPTION OF DRAWINGS

Like reference symbols in the various drawings indicate like elements.

DETAILED DESCRIPTION

In some semiconductor chip fabrication processes an overlying layer, e.g., silicon oxide or polysilicon, is polished until an underlying layer, e.g., a dielectric, such as silicon oxide, silicon nitride or a high-K dielectric, is exposed. For some applications, it may be possible to optically detect the exposure of the underlying layer. For some applications, the underlying layer has a different coefficient of friction against the polishing layer than the overlying layer. As a result, when the underlying layer is exposed, the torque required by a motor to cause the platen or carrier head to rotate at a specified rotation rate changes. The polishing endpoint can be determined by detecting this change in motor torque.

Figure 1:
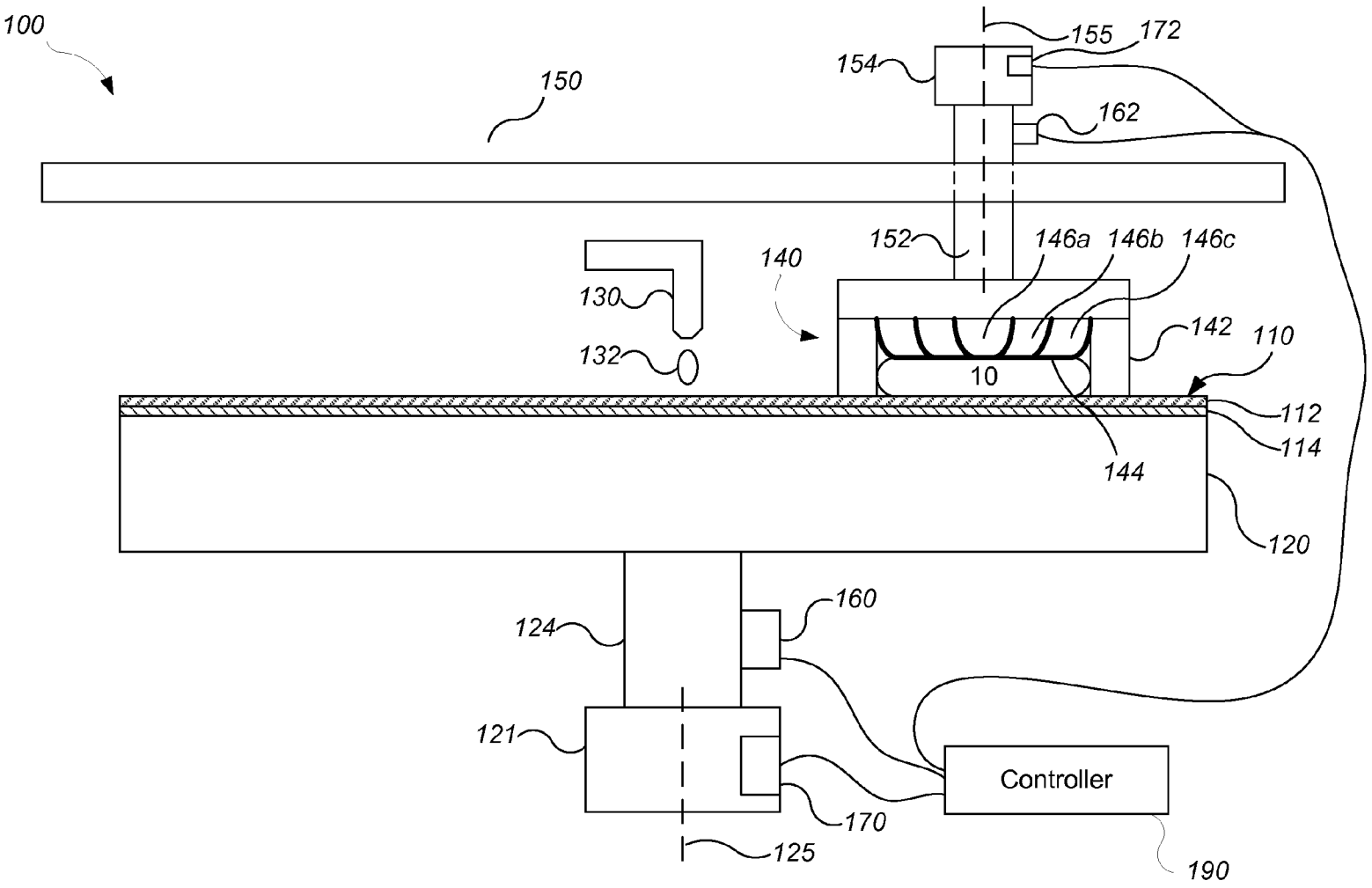
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated. The polishing pad 110 can be a two-layer polishing pad with an outer polishing layer 112 and a softer backing layer 114. The platen is operable to rotate about an axis 125. For example, a motor 121, e.g., a DC induction motor, can turn a drive shaft 124 to rotate the platen 120.

The polishing apparatus 100 can include a port 130 to dispense polishing liquid 132, such as abrasive slurry, onto the polishing pad 110 to the pad. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110. Each carrier head 140 can have independent control of the polishing parameters, for example pressure, associated with each respective substrate.

The carrier head 140 can include a retaining ring 142 to retain the substrate 10 below a flexible membrane 144. The carrier head 140 also includes one or more independently controllable pressurizable chambers defined by the membrane, e.g., three chambers 146*a*-146*c*, which can apply independently controllable pressures to associated zones on the flexible membrane 144 and thus on the substrate 10. Although only three chambers are illustrated in FIG. 1 for ease of illustration, there could be one or two chambers, or four or more chambers, e.g., five chambers.

The carrier head 140 is suspended from a support structure 150, e.g., a carousel, and is connected by a drive shaft 152 to a carrier head rotation motor 154, e.g., a DC induction motor, so that the carrier head can rotate about an axis 155. Optionally each carrier head 140 can oscillate laterally, e.g., on sliders on the carousel 150, or by rotational oscillation of the carousel itself. In typical operation, the platen is rotated about its central axis 125, and each carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110.

A controller 190, such as a programmable computer, is connected to the motors 121, 154 to control the rotation rate of the platen 120 and carrier head 140. For example, each motor can include an encoder that measures the rotation rate of the associated drive shaft. A feedback control circuit, which could be in the motor itself, part of the controller, or a separate circuit, receives the measured rotation rate from the encoder and adjusts the current supplied to the motor to ensure that the rotation rate of the drive shaft matches at a rotation rate received from the controller.

The polishing apparatus also includes an in-situ monitoring system 160, e.g., a motor current or motor torque monitoring system, which can be used to determine a polishing endpoint. The in-situ monitoring system 160 includes a sensor to measure a motor torque and/or a current supplied to a motor.

For example, a torque meter 160 can be placed on the drive shaft 124 and/or a torque meter 162 can be placed on the drive shaft 152. The output signal of the torque meter 160 and/or 162 is directed to the controller 190.

Alternatively or in addition, a current sensor 170 can monitor the current supplied to the motor 121 and/or a current sensor 172 can monitor the current supplied to the motor 154. The output signal of the current sensor 170 and/or 172 is directed to the controller 190. Although the current sensor is illustrated as part of the motor, the current sensor could be part of the controller (if the controller itself outputs the drive current for the motors) or a separate circuit.

The output of the sensor can be a digital electronic signal (if the output of the sensor is an analog signal then it can be converted to a digital signal by an ADC in the sensor or the controller). The digital signal is composed of a sequence of signal values, with the time period between signal values depending on the sampling frequency of the sensor. This sequence of signal values can be referred to as a signal-versus-time curve. The sequence of signal values can be expressed as a set of values $x_n$.

As noted above, the "raw" digital signal from the sensor can be smoothed using a filter that incorporates linear prediction. Linear prediction is a statistical technique that uses current and past data to predict future data. Linear prediction can be implemented with a set of formulas that keep track of the autocorrelation of current and past data, and linear prediction is capable of predicting data much further into the future than is possible with simple polynomial extrapolation.

Although linear prediction can be applied to filtering of signals in other in-situ monitoring systems, linear prediction is particularly applicable to filtering of signals in a motor torque or motor current monitoring system. The motor torque and motor current signal-versus-time curves can be corrupted not only by random noise, but also by a large systematic, sinusoidal disturbance due to sweeping of the carrier head 140 across the polishing pad. For motor current signals, linear prediction can predict three or four sweep periods into the future with good accuracy.

In a first implementation, linear prediction is applied to the current data set (the causal data of the current and past signal values) to generate an extended data set (i.e., the current data set plus the predicted values) and then applies a frequency-domain filter to the resulting extended data set. Linear prediction can be used to predict 40-60 values (which can correspond to 4 or 5 carrier head sweeps). Because frequency domain filters exhibit little or no filter delay, filter delay can be significantly reduced. A frequency domain filter can exhibit edge distortion at both the beginning and end of the data set. By using linear prediction first, the edge distortion is effectively moved away from the actual current data (which is no longer situated at the end of the data set).

The linear prediction can be expressed as follows:

$$\hat{x}_n = \sum_{i=1}^{p} a_i x_{n-i}$$

where $\hat{x}_n$ is a predicted signal value, p is the number of data points used in the calculation (which can be equal to n−1), $x_{n-i}$ are previous observed signal values, and $a_i$ is the predictor coefficient. To generate additional predicted values, e.g., $\hat{x}_{n+1}$, the calculation can be iterated by incrementing n and using the previously predicted values in $x_{n-i}$.

In order to generate the predictor coefficients $a_i$, root mean square criterion, which is also called the autocorrelation criterion, is used. The autocorrelation of the signal of the signal $x_n$ can be expressed as follows:

$$R_i = E\{x_n x_{n-i}\}$$

where R is the autocorrelation of the signal $x_n$ and where E is the expected value function, e.g., the average value. The autocorrelation criterion can be expressed as follows:

$$\sum_{i}^{p} a_i R_{i-j} = -R_j$$

for 1<<j<<p.

In a second implementation, linear prediction is used in conjunction with a Kalman filter. Conventional Kalman filters are described in "An Introduction to the Kalman Filter" by Welch and Bishop. A standard Kalman filter (specifically, a "discrete Kalman filter (DKF)") has smoothing capabilities because the noise characteristics of the system being filtered are included in the formulas. A standard Kalman filter also employs a predictive step that estimates a future data value based on current and past data. The predictive step usually only extends into the future by one data step (i.e. near-term prediction). However, this sort of near-term prediction may not sufficiently reduce filter delay for CMP motor torque data to be commercially viable. By using linear prediction instead of the standard Kalman prediction step, the "modified Kalman" filter minimizes filter delay significantly.

The implementation of the Kalman technique described below includes a modified technique for determining the a priori estimate of the state variable, and a different order of computations downstream of the a priori estimate. It should be understood that other implementations that use linear prediction are possible.

For a motor current or motor torque monitoring technique, the substrate friction is the variable of interest. However, the measured quantity is the total friction, which as noted above includes a systematic, sinusoidal disturbance due to sweeping of the carrier head 140 across the polishing pad. For the equations below, the state variable, x, is the substrate friction, whereas the measured quantity, z, is the total friction, e.g., the motor current measurements.

For a particular time step k, an a priori estimate of the state variable, $\hat{x}_k^-$, is calculated. The a priori estimate $\hat{x}_k^-$ can be calculated as the mean of a plurality of values of the measured quantity, z, measured prior to step k, and a plurality of linearly interpolated values of z. Where a cyclic disturbance is present, the a priori estimate $\hat{x}_k^-$ can be calculated from values over one cycle, with half of the cycle (the "left" or past half) comprised of measured data, and half of the cycle (the "right" or future half) generated using linear prediction. The a priori estimate $\hat{x}_k^-$ can be calculated as the mean of a measured quantity, i.e., $\hat{x}_k^-=\bar{z}$, with the mean conducted over one cycle, centered at time step k. Thus, the a priori estimate $\hat{x}_k^-$ can be calculated as the mean of the values that include both measured data and linearly predicted data. In the case of motor torque measurements, this cycle is the head sweep cycle.

For example, $\hat{x}^-_k$ can be calculated as follows $$\hat{x}_k^- = \frac{1}{1+2L}\sum_{i=k-L}^{k+L} z_i, \qquad \text{(eq. TT.1)}$$

where 2L+1 is a number of data points used in the calculation, $z_i$ are previous observed measurements of z for L≥0, and $z_{k-L}$ are predicted values for z for L<0. The predicted values for z can be generated using liner prediction.

For the case involving CMP motor current or motor torque measurements, the dominant contribution to the friction is the sweep friction, which exhibits a nearly sinusoidal signal as a function of time. To remove the sweep friction, this approach sums the measured signal over one sweep cycle and divides by the number of data points in the sweep cycle, thus giving the mean signal over one sweep cycle. This mean signal approximates the substrate friction well. This formula filters out the sinusoidal behavior of the sweep friction.

In a standard Kalman filter, the quantity A is computed before the a priori estimate is made because it is used to compute the a priori estimate. In this modified Kalman method, A is not used in the a priori estimate (eq. TT.1 above), but it is needed for the next time update equation involving $P^-_k$, the a priori estimate error covariance. In one implementation, the formula for A is as follows:

$$A=\hat{x}^-_k/\hat{x}_{k-1} \qquad \text{(TT.2)}$$

where $\hat{x}_{x-1}$ is the a posteriori state estimate from the previous step.

Next, the a priori estimate error covariance, $P^-_k$, is calculated. $P^-_k$ can be computed using the standard Kalman formula:

$$P^-_k=A^2P_{k-1}+Q \qquad \text{(TT.3)}$$

In this implementation, A is a scalar. However, in the more general case, A can be a matrix, and the equation would be modified accordingly.

Next, the residual, Rs, and the quantity H can be calculated. The residual, Rs, is computed independently of H, and then H is estimated. The residual is computed as follows:

$$Rs=\text{measured value}-fut[1] \qquad \text{(MM.1)}$$

where fut[1] is the predicted value for the measurement, with the predicted value calculated using the linear prediction formula on all previous measured data. The suffix [1] refers to the fact that the prediction takes place one step into the future.

In some implementations, Rs can be calculated as $$Rs = z_k - \sum_{i=1}^{p} a_i z_{k-i}$$

with values for $a_i$ calculated as described above for linear prediction.

H can be calculated using the following formula:

$$H = \frac{fut[1]}{\hat{x}_k^-} \qquad \text{(MM.2)}$$

Once H, R and $P^-_k$, have been calculated, the measurement update equations can be performed.

$$K_k = \frac{HP_k^-}{(H^2P_k^- + R)} \qquad \text{(MM.3)}$$

$$\hat{x}_k = \hat{x}_k^- + K_k(z_k - H\hat{x}_k^-) \qquad \text{(MM.4)}$$

$$P_k = (1 - K_k H)P_k^- \qquad \text{(MM.5)}$$

Both implementations described above reduce filter delay, with the tradeoff being that the data might not be as smooth as with traditional smoothing filters.

Figure 2:
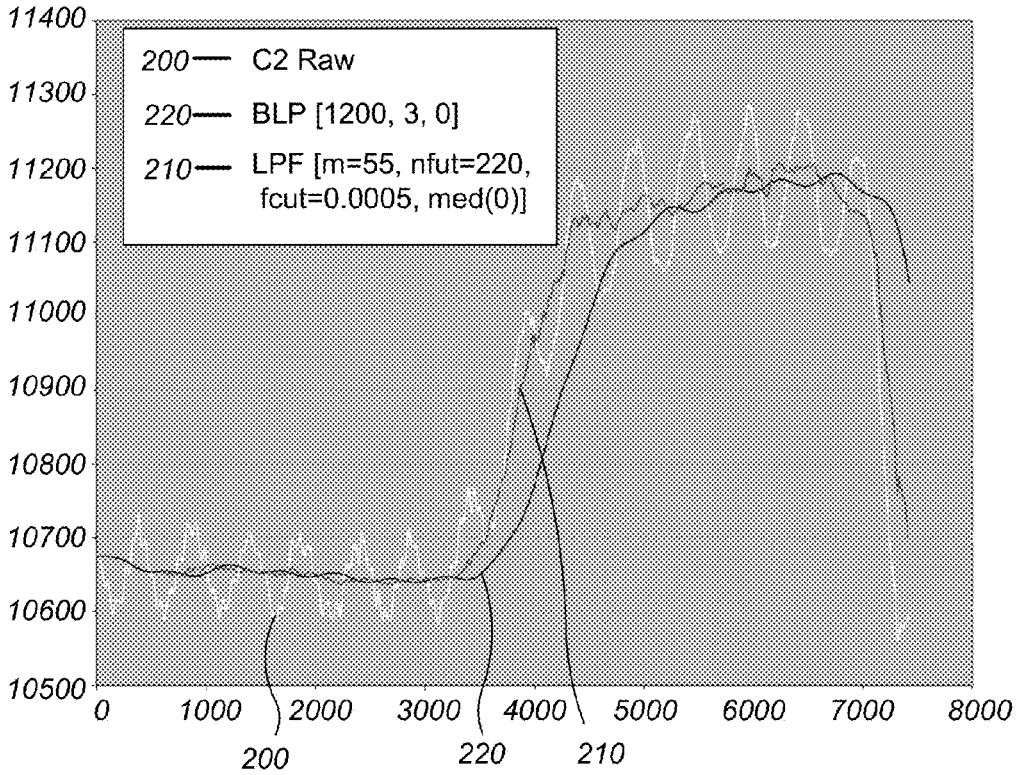
FIG. 2 is a graph comparing filtered platen torque signals generated by a customized filter and a standard low pass filter.

FIG. 2 illustrates a graph of the "raw" platen torque signal 200, a filtered signal 210 generated by applying the first implementation of the modified filter to the raw platen torque signal, and a filtered signal 220 generated by applying a standard low pass filter to the raw platen torque signal. The modified filter provides significant reduction of delay.

Figure 3:
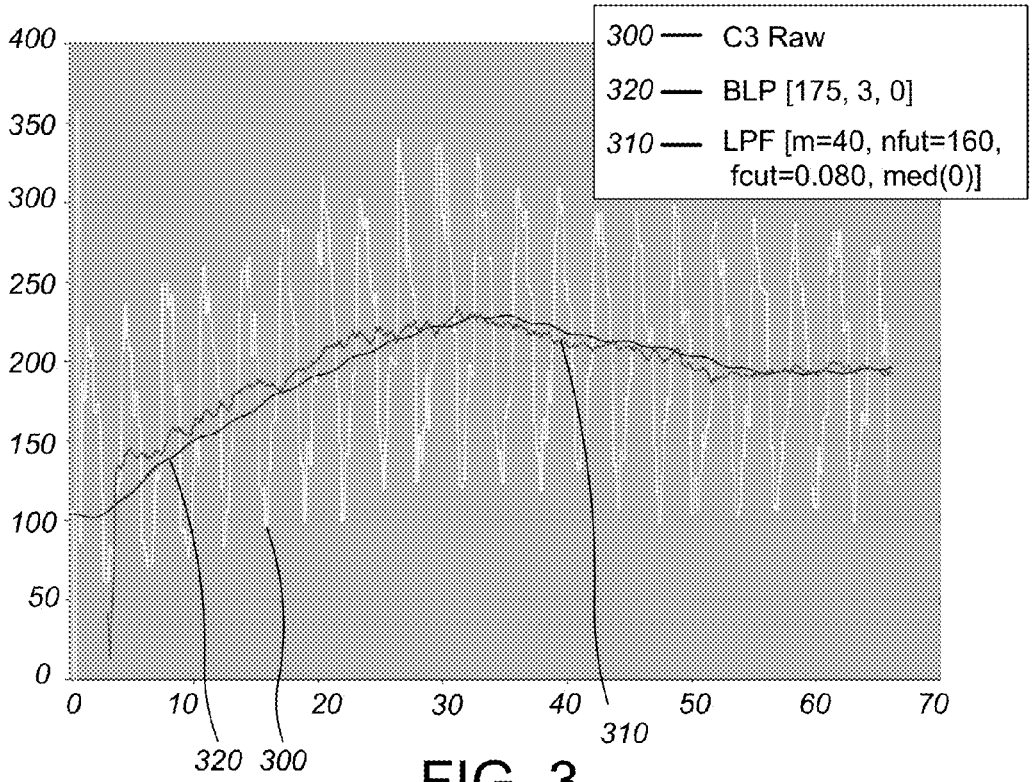
FIG. 3 is a graph comparing filtered platen torque signals generated by a customized filter and a standard low pass filter.

FIG. 3 illustrates a graph of the "raw" head torque signal 300, a filtered signal 310 generated by applying the first implementation of the modified filter to the raw head torque signal, and a filtered signal 320 generated by applying a standard low pass filter to the raw head torque. The modified filter still provides a reduction of delay, although there is only a small reduction in delay because the change in wafer friction is small.

Implementations and all of the functional operations described in this specification can be implemented in digital electronic circuitry, or in computer software, firmware, or hardware, including the structural means disclosed in this specification and structural equivalents thereof, or in combinations of them. Implementations described herein can be implemented as one or more non-transitory computer program products, i.e., one or more computer programs tangibly embodied in a machine readable storage device, for execution by, or to control the operation of, data processing apparatus, e.g., a programmable processor, a computer, or multiple processors or computers.

A computer program (also known as a program, software, software application, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. Processors suitable for the execution of a computer program include, by way of example, both general and special purpose microprocessors, and any one or more processors of any kind of digital computer.

Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

The above described polishing apparatus and methods can be applied in a variety of polishing systems. Either the polishing pad, or the carrier head, or both can move to provide relative motion between the polishing surface and the wafer. For example, the platen may orbit rather than rotate. The polishing pad can be a circular (or some other shape) pad secured to the platen. Some aspects of the endpoint detection system may be applicable to linear polishing systems (e.g., where the polishing pad is a continuous or a reel-to-reel belt that moves linearly). The polishing layer can be a standard (for example, polyurethane with or without fillers) polishing material, a soft material, or a fixed-abrasive material. Terms of relative positioning are used; it should be understood that the polishing surface and wafer can be held in a vertical orientation or some other orientations.

While this specification contains many specifics, these should not be construed as limitations on the scope of what may be claimed, but rather as descriptions of features that may be specific to particular embodiments of particular inventions. In some implementations, the method could be applied to other combinations of overlying and underlying materials, and to signals from other sorts of in-situ monitoring systems, e.g., optical monitoring or eddy current monitoring systems.

What is claimed is:

1. A computer program product, comprising a non-transitory computer-readable medium having instructions, which, when executed by a processor of a polishing system, causes the polishing system to:

polish a substrate;

during polishing, monitor the substrate with an in-situ monitoring system, the monitoring including generating a signal from a sensor, the signal including a sequence over time of measured values;

filter the signal to generate a filtered signal, the filtered signal including a sequence over time of adjusted values, the instructions to filter including instructions to, for each adjusted value in the sequence over time of adjusted values, generate at least one predicted value from the sequence over time of measured values from the sensor using linear prediction, and calculate the adjusted value from the sequence over time of measured values from the sensor and the predicted value; and determine at least one of a polishing endpoint or an adjustment for a polishing rate from the filtered signal.

2. The computer program product of claim 1, wherein the instructions to generate at least one predicted value comprise instructions to generate a plurality of predicted values.

3. The computer program product of claim 2, wherein using linear prediction comprises a calculation of a first predicted signal value $$\hat{x}_n = \sum_{i=1}^{p} a_i x_{n-i}$$

where $\hat{x}_n$ is the first predicted signal value, p is a number of signal values used in the calculation (which can be equal to n−1), $x_{n-i}$ are previous observed signal values, and $a_i$ is a predictor coefficient.

4. A polishing system, comprising:

a platen to hold a polishing pad;

a carrier head to hold a substrate against the polishing pad during polishing;

an in-situ monitoring system, the monitoring including a sensor to monitor the substrate during polishing and generate a signal, the signal including a sequence over time of measured values; and a controller configured to filter the signal to generate a filtered signal, the filtered signal including a sequence over time of adjusted values, wherein the filter is configured to, for each adjusted value in the sequence over time of adjusted values, generate at least one predicted value from the sequence over time of measured values from the sensor using linear prediction, and calculate the adjusted value from the sequence over time of measured values from the sensor and the predicted value, and determine at least one of a polishing endpoint or an adjustment for a polishing rate from the filtered signal.

5. The polishing system of claim 4, wherein the in-situ monitoring system comprises a motor current monitoring system or motor torque monitoring system.

6. The polishing system of claim 5, wherein the in-situ monitoring system comprises a carrier head motor current monitoring system or a carrier head motor torque monitoring system.

7. The polishing system of claim 5, wherein the motor current monitoring system or motor torque monitoring system comprises a platen motor current monitoring system or a platen motor torque monitoring system.

8. The polishing system of claim 5, wherein the in-situ monitoring system comprises a motor current monitoring system.

9. The polishing system of claim 4, wherein generating at least one predicted value comprises generating a plurality of predicted values.

10. The polishing system of claim 9, wherein calculating the adjusted value includes applying a frequency domain filter.

11. The polishing system of claim 9, wherein the plurality of predicted values comprise at least twenty values.

12. The polishing system of claim 9, wherein the linear prediction comprises a calculation of a first predicted signal value $$\hat{x}_n = \sum_{i=1}^{p} a_i x_{n-i}$$

where $\hat{x}_n$ is the first predicted signal value, p is a number of signal values used in the calculation (which can be equal to n−1), $x_{n-i}$ are previous observed signal values, and $a_i$ is a predictor coefficient.

13. The polishing system of claim 12, wherein the linear prediction comprises a calculation of a second predicted signal value $$\hat{x}_{n+L} = \sum_{i=1}^{p} a_i x_{n+L-i}$$

where $\hat{x}_{n+L}$ is the second predicted signal value, L is greater than 0, p is a number of signal values used in the calculation (which can be equal to n+L−1), $x_{n+L-i}$ are previous observed signal values for L−i≥0, and $x_{n+L-i}$ are predicted signal values for L−i<0, and $a_i$ is a predictor coefficient.

14. The polishing system of claim 13, wherein $$\sum_{i}^{P} a_i R_{i-j} = -R_j$$

and $$R_i = E\{x_n x_{n-i}\}$$

where R is the autocorrelation of the signal $x_n$ and where E is an expected value function.

15. The polishing system of claim 4, wherein the controller is configured to apply a modified Kalman filter in which linear prediction is used to calculate the at least one predicted signal value to calculate the adjusted value.

16. The polishing system of claim 15, wherein the modified Kalman filter uses the following time update equation:

$$\hat{x}_k^- = \frac{1}{1+2L}\sum_{i=k-L}^{k+L} z_i$$

where 2L+1 is a number of data points used in the calculation, $z_i$ are previous measured signal values for L≥0, and $z_{k-L}$ are the predicted signal values for z for L<0.

17. The polishing system of claim 16, wherein the modified Kalman filter comprises a calculation of an a priori estimate error covariance, $P^-_k$ as $$P^-_k = A^2 P_{k-1} + Q$$

where $$A = \hat{x}^-_k / \hat{x}_{k-1}$$

where $\hat{x}_{k-1}$ is an a posteriori state estimate from the previous step predicted signal.

18. The polishing system of claim 17, wherein the controller is configured to calculate a residual Rs as $$Rs = \text{measured value} - fut[1]$$

where fut[1] is a predicted value for the measurement, with the predicted value calculated using the linear prediction formula on all previous signal data.

19. The polishing system of claim 18, wherein the controller is configured to calculate a value H as $$H = \frac{fut[1]}{\hat{x}_k^-}.$$

20. The polishing system of claim 19, wherein the modified Kalman filter comprises a calculation of $$K_k = \frac{HP_k^-}{(H^2 P_k^- + R)}$$

$$\hat{x}_k = \hat{x}_k^- + K_k(z_k - H\hat{x}_k^-)$$

$$P_k = (1 - K_k H)P_k^-.$$

* * * * *